US012492443B2

(12) United States Patent
Valdez et al.

(10) Patent No.: US 12,492,443 B2
(45) Date of Patent: Dec. 9, 2025

(54) HEAT TREATED COILED TUBING

(71) Applicant: Tenaris Coiled Tubes, LLC, Houston, TX (US)

(72) Inventors: Martin Valdez, Buenos Aires (AR); Jorge Mitre, Houston, TX (US)

(73) Assignee: Tenaris Coiled Tubes, LLC, Houston, TX (US)

( * ) Notice: Subject to any disclaimer, the term of this patent is extended or adjusted under 35 U.S.C. 154(b) by 646 days.

(21) Appl. No.: 15/076,305

(22) Filed: Mar. 21, 2016

(65) Prior Publication Data

US 2016/0281188 A1 Sep. 29, 2016

Related U.S. Application Data

(60) Provisional application No. 62/139,536, filed on Mar. 27, 2015.

(51) Int. Cl.

| | |
|---|---|
| ***C21D 9/14*** | (2006.01) |
| ***C21D 1/56*** | (2006.01) |
| ***C21D 6/00*** | (2006.01) |
| ***C21D 8/10*** | (2006.01) |
| ***C22C 38/02*** | (2006.01) |
| ***C22C 38/04*** | (2006.01) |

(52) U.S. Cl.
CPC ..... *C21D 9/14* (2013.01); *C21D 1/56* (2013.01); *C21D 6/005* (2013.01); *C21D 6/008* (2013.01); *C21D 8/105* (2013.01); *C22C 38/02* (2013.01); *C22C 38/04* (2013.01)

(58) Field of Classification Search
CPC ..... C21D 9/14; C21D 1/56
See application file for complete search history.

(56) References Cited

U.S. PATENT DOCUMENTS

| | | | |
|---|---|---|---|
| 4,629,218 | A | 12/1986 | Dubois |
| 4,863,091 | A | 9/1989 | Dubois |
| 5,080,727 | A | 1/1992 | Aihara et al. |
| 5,191,911 | A | 3/1993 | Dubois |
| 5,328,158 | A | 7/1994 | Lewis et al. |
| 5,456,405 | A | 10/1995 | Stagg |
| 6,006,789 | A | 12/1999 | Toyooka |
| 6,527,056 | B2 | 3/2003 | Newman |
| 9,163,296 | B2 | 10/2015 | Valdez et al. |

(Continued)

FOREIGN PATENT DOCUMENTS

| | | | |
|---|---|---|---|
| CA | 2657518 A1 * | 1/2008 | ..... B21C 37/08 |
| CN | 101480671 | 7/2009 | |

(Continued)

OTHER PUBLICATIONS

Savatori et al.: European Commission Report, EUR 2006, EUR2207, 3 pp. STN_ABSTRACT.

(Continued)

*Primary Examiner* — Anthony M Liang
(74) *Attorney, Agent, or Firm* — Morgan, Lewis & Bockius LLP

(57) ABSTRACT

Embodiments of a method of heat treating a coiled tube, in particular coiled tubes for use in the oil and gas industry, and pipes produced from the methods. In particular, embodiments of the heat treating method can utilized tempering without bending in order to avoid the generation of subsequent defects.

9 Claims, 9 Drawing Sheets

(56) References Cited

U.S. PATENT DOCUMENTS

| | | | | |
|---|---|---|---|---|
| 9,803,256 | B2 | 10/2017 | Valdez | |
| 2005/0087269 | A1 | 4/2005 | Merwin | |
| 2006/0213247 | A1 | 9/2006 | Crawford | |
| 2006/0231168 | A1 | 10/2006 | Nakamura et al. | |
| 2008/0115863 | A1 | 5/2008 | Kalb | |
| 2008/0286504 | A1 | 11/2008 | Asahi | |
| 2009/0148334 | A1 | 6/2009 | Stephenson | |
| 2010/0136363 | A1 | 6/2010 | Valdez et al. | |
| 2011/0117693 | A1* | 5/2011 | Palm | H01L 31/1864 438/97 |
| 2011/0259482 | A1 | 10/2011 | Peters et al. | |
| 2011/0284137 | A1 | 11/2011 | Kami et al. | |
| 2012/0186686 | A1* | 7/2012 | Valdez | C22C 38/02 138/177 |
| 2013/0199674 | A1 | 8/2013 | Altshuler et al. | |
| 2013/0264123 | A1 | 10/2013 | Altshuler et al. | |
| 2014/0057121 | A1 | 2/2014 | Altshuler et al. | |

FOREIGN PATENT DOCUMENTS

| | | | | |
|---|---|---|---|---|
| CN | 101898295 | | 12/2010 | |
| EP | 0151838 | A1 * | 8/1985 | C21D 9/085 |
| EP | 0788850 | | 8/2005 | |
| EP | 2239343 | | 10/2010 | |
| EP | 2778239 | A1 | 9/2014 | |
| EP | 2479294 | A1 | 11/2021 | |
| GB | 498472 | | 1/1939 | |
| JP | S 60-215719 | | 10/1985 | |
| JP | H-06128645 | A * | 5/1994 | |
| JP | H09217120 | | 8/1997 | |
| JP | 2001220653 | | 8/2001 | |
| JP | 2010270394 | | 12/2010 | |
| WO | WO 2006/078768 | | 7/2006 | |
| WO | WO 2013/007729 | | 1/2013 | |

OTHER PUBLICATIONS

Canale et al., A historical overview of steel tempering parameters, International Journal of Microstructure and Materials Properties, vol. 3, Nos. 4-5, 2008, pp. 474-525.

One-stop-shop for induction tube technologies, SMS Elotherm GmbH, Jul. 2014, p. 48.

Southwestern Pipe, Inc., Houston, Texas; Slides prepared by Southwestern Pipe, Inc. of Houston, Texas.

* cited by examiner

HEAT TREATED COILED TUBING

INCORPORATION BY REFERENCE TO ANY PRIORITY APPLICATIONS

This Application claims from the benefit of U.S. Provisional Application No. 62/139,536, filed Mar. 27, 2015, titled "HEAT TREATED COILED TUBING," the entirety of which is incorporated herein by reference.

BACKGROUND

Field

Embodiments of the present disclosure generally relate to a method for continuous heat treatment of a pipe in a restricted space with minimal deformation of the pipe during the heat treatment, and the pipe produced by the method.

Description of the Related Art

A coiled tube is a continuous length of tube coiled onto a spool, which is later uncoiled while entering service such as within a wellbore. Coiled tubes may be made from a variety of steels such as stainless steel or carbon steel pipes. Coiled tubes can, for example, have an outer diameter between about 1 inch and about 5 inches, a wall thickness between about 0.080 inches and about 0.300 inches, and lengths up to about 50,000 feet. For example, typical lengths are about 15,000 feet, but lengths can be between about 10,000 feet to about 40,000 feet.

Coiled tubes can be produced by joining flat metal strips to produce a continuous length of flat metal that can be fed into a forming and welding line (e.g., ERW, Laser or other) of a tube mill where the flat metal strips are welded along their lengths to produce a continuous length of tube that is coiled onto a spool after the pipe exits the welding line. In some cases, the strips of metal joined together have different thickness and the coiled tube produced under this condition is called "tapered coiled tube" and this continuous tube has varying internal diameter due to the varying wall thickness of the resulting tube.

Another alternative to produce coiled tubes includes continuous hot rolling of tubes of an outside diameter different than the final outside diameter. For example, U.S. Pat. No. 6,527,056 describes a method producing coiled tubing strings in which the outer diameter varies continuously or nearly continuously over a portion of the string's length. Int'l. Pat. Publication No. WO2006/078768 describes a method in which the tubing exiting the tube mill is introduced into a forging process that substantially reduces the deliberately oversized outer diameter of the coil tubing in process to the nominal or target outer diameter. European Pat. No. 0788850 B1 describes an example of a steel pipe-reducing apparatus, the entirety of each of which is hereby incorporated by reference.

U.S. Pat. No. 5,328,158, the entirety of which is incorporated by reference herein, illustrates a process for heat treating coiled tubing in which the entirety of the coiled tubing is introduced into a furnace (or other heated chamber) for tempering, which is known in the art. In order to achieve the minimum required residence times in the furnace, the coiled tubing is bent several times inside the heated chamber. However, this bending can cause significant defects/cracking in the coiled tube. If defects were introduced into the tube during the coiling, this can cause breakage of the tube during the coiling process or while the tube is coiled.

For example, problems may also occur where a tube accidentally uncoils itself because of the defects releasing energy from the coiling. This unintended coiling can put persons, equipment, and installations at risk to damage.

SUMMARY

At least some of the problems identified above are solved by the embodiments of the methods and apparatuses (such as pipes and coiled tubing) described herein.

Disclosed herein in some embodiments are improvements to the heat treatment production of coiled tubing in which a minimum amount of tempering can be used before any subsequent bending or any significant subsequent bending is performed.

Disclosed herein are embodiments of a method of heat treating coiled tubing comprising tempering an as-quenched pipe without bending in order to avoid the generation of subsequent defects in the as-quenched or tempered material.

In some embodiments, all tempering processes can be performed totally without introducing significant bending in the pipe. In some embodiments, all tempering processes can be performed totally without introducing any bending in the pipe.

In some embodiments, the amount of tempering introduced into the pipe before any bending can be at least 10% of the total tempering required to produce the higher coiled tubing grade with a selected chemistry. In some embodiments, the amount of tempering introduced into the pipe before any bending can be at least 50% of the total tempering required to produce the higher coiled tubing grade with the selected chemistry. In some embodiments, the amount of tempering introduced into the pipe before any bending can be at least 90% of the total tempering required to produce the higher coiled tubing grade with the selected chemistry. In some embodiments, the amount of tempering introduced into the pipe before any bending can be 100% of the total tempering required to produce the higher coiled tubing grade with the selected chemistry.

In some embodiments, the amount of tempering introduced into the pipe before any bending can be at least equivalent to a total tempering required to produce a higher coiled tubing grade with fatigue resistance using the selected chemistry. In some embodiments, the final coiled tube can comprise a medium carbon steel in which a 140 ksi pipe has been produced with acceptable fatigue life after bending (resistance to bending), and the yield strength of the pipe before applying any bending is reduced to 140 ksi.

Also disclosed herein are embodiments of a method of heat treating coiled tubing, the coiled tubing comprising a pipe, wherein the method comprises unspooling the coiled tubing, heating the unspooled coiled tubing to a temperature above Ac3, quenching the unspooled coiled tubing, and tempering the unspooled coiled tubing, wherein the tempering is performed prior to any subsequent bending of the coiled tubing.

In some embodiments, the method can further comprise coiling the unspooled coiled tubing after the tempering wherein defects are substantially not formed during coiling. In some embodiments, the tempering that is performed prior to any subsequent bending of the coiled tubing can be performed in a first tempering stage, and further comprising a second tempering stage wherein the pipe is tempered within a furnace while being bent.

In some embodiments, the tempering performed prior to any subsequent bending can be at least 50% of the total tempering of the coiled tubing. In some embodiments, the tempering performed prior to any subsequent bending can be at least 90% of the total tempering of the coiled tubing. In some embodiments, the tempering performed prior to any subsequent bending can be 100% of the total tempering of the coiled tubing.

In some embodiments, the tempering performed prior to any subsequent bending can provide the pipe with at least a minimum ductility (ΔMIN) to avoid suffering any damage caused by coiling strain ($\varepsilon_C$) during subsequent coiling.

Also disclosed herein are embodiments of a method of heat treating coiled tubing, wherein the coiled tubing comprises a pipe, wherein the method comprises tempering the pipe without any bending or without any significant bending of the pipe during the tempering, wherein said tempering provides the pipe with at least a minimum ductility (ΔMIN) to avoid suffering any damage caused by coiling strain ($\varepsilon_C$) during subsequent coiling.

In some embodiments, the pipe can be uncoiled from a spool prior to tempering. In some embodiments, the method can further comprise tempering an as-quenched pipe without significant bending of the as-quenched pipe. In some embodiments, the method can further comprise applying an additional tempering to the pipe while the pipe is being bent. In some embodiments, the method can further comprise coiling the pipe after the tempering wherein defects are substantially not formed during coiling.

Further disclosed herein are embodiments of a method of producing coiled tubing, comprising providing a pipe in an unspooled configuration, heating the unspooled pipe to a temperature above Ac3, quenching the unspooled pipe, tempering the unspooled pipe in a first tempering operation, the first tempering operation being applied to the unspooled pipe with the unspooled pipe in either a straight configuration, with at most one bend or without introducing significant bending, to provide the unspooled pipe with a minimum ductility for later coiling to avoid defect generation, and tempering the pipe in a second tempering operation after the unspooled pipe has achieved the minimum ductility, wherein the pipe during the second tempering operation is bent in a coiling process to coil the pipe onto a spool, wherein the conditions of the first tempering operation are determined based on calculating the minimum ductility for later coiling to avoid defect generation, and wherein the minimum ductility is calculated based on determining a coiling strain that will be introduced to the pipe when the pipe is bent in the coiling process to coil the pipe onto the spool.

In some embodiments, the coiling strain can be a function of an outer diameter of the pipe, a wall thickness of the pipe, and a coil radius. In some embodiments, the conditions of the second tempering operation can be selected to attain the final mechanical properties of the coiled tubing. In some embodiments, the second tempering operation can be conducted in a confined furnace.

Also disclosed are embodiments of pipes produced by the disclosed methods.

DETAILED DESCRIPTION

Figure 1:
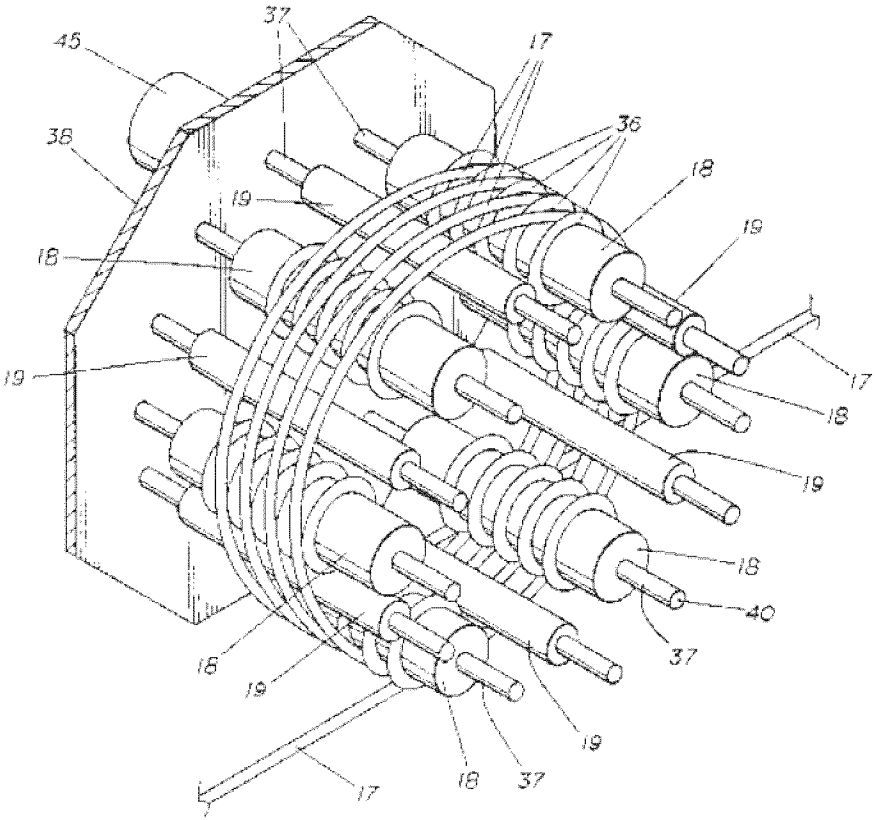
FIG. 1 Prior Art
FIG. 1 shows a heated chamber of the prior art.

Disclosed herein are embodiments of manufacturing methods which can produce coiled tubes that are defect free, or substantially defect free, as well as embodiments of the produced coiled tubes. The coiled tubes can be, for example, steel tubes, and are typically produced in a spool. In some embodiments, the methods and tubes disclosed herein can be used in the oil and gas industry, such as for underwater transportation of oil.

In some embodiments, defects can be material discontinuities (e.g., cracks) generated due to the application of strain to a material that is brittle due to limited tempering. As the performance of a coiled tube can be related to fatigue loads, defect free tubes can be advantageous in order for the performance to not be affected.

During the production of coiled tubing, a heat treatment is used to modify specific properties/parameters within the tubes (e.g., yield strength, toughness, and ductility). Embodiments of this disclosure relates to specific methodology for heat treatment that can result in a defect free, or substantially defect free, product.

In some embodiments, a quench and temper process can be used as a heat treatment of coiled tubes, and is described herein. In some embodiments, a continuous and dynamic heat treatment (CDHT) as disclosed in U.S. Pat. No. 9,163,296, hereby incorporated by reference in its entirety, can be used as well and the particular type of heat treatment is not limiting. Other types of heat treatment may also be utilized.

Current Heat Treatment Issues

During quench and temper heat treatment, the steel tube can be heated above Ac3 (the temperature at which ferrite completes its transformation into austenite during heating) to guarantee full austenitization, and then it can be rapidly cooled down to form martensite. The martensitic steel is called the "as quenched" state. The material can then be sub-critically heated (e.g., below Ac3) to different temperatures to decrease/increase/or change the properties to the desired range according to the grade, e.g., tempering.

In some embodiments, the coiled tube can be in an unspooled fashion for heat treatment. This can occur prior to the initial spooling of the coiled tube, or can occur after uncoiling of a previously coiled tube. As quenching requires fast cooling through the entire wall thickness immediately after austenitization, the quenching process is preferably performed in the unspooled fashion of the pipe in order to achieve the advantageous cooling rates. Even if the heat treatment is a normalization heat treatment, thus austenitization and slow air cooling is used, the heat treatment of already spooled coiled tubing is not considered as an adequate alternative in these embodiments.

The austenitization heat treatment is not used on coiled tubing because the coiled tubing could easily expand during heating, introducing tension in the spool. This could result in severe deformation of the pipe and problems for subsequent unspooling. Tensions in the coiled tubing could also arise from the volume changes associated to the phase transformations during quenching.

After quenching the material, the tube can be re-heated for tempering. In the procedures known in the art, the as-quenched tube can be coiled/spooled and the whole spool can be introduced into a furnace (since no transformation occurs, volume changes are minimum and this is less critical than normalizing or quenching). However, the as-quenched steel tube can be extremely brittle and might crack, break, or deform while spooling, thus producing damage of the pipe and a safety hazard to operators handling the pipe.

For example, FIG. 1, taken from U.S. Pat. No. 5,328,158, illustrates a process for heat treating coiled tubing in which the entirety of the coiled tubing is introduced into a furnace (or other heated chamber) for tempering. As shown, in order to achieve the minimum required residence times, the coiled tubing is bent several times inside the heated chamber.

In some embodiments, a bend is formed upon an application of strain to the coiled to, such as in order to fit the coiled tube within a furnace. Typically, the number of bends can be related to the residence time of the tube in the furnace and size of the furnace. The longer the residence time, the more bends can be used in the furnace.

Figure 2:
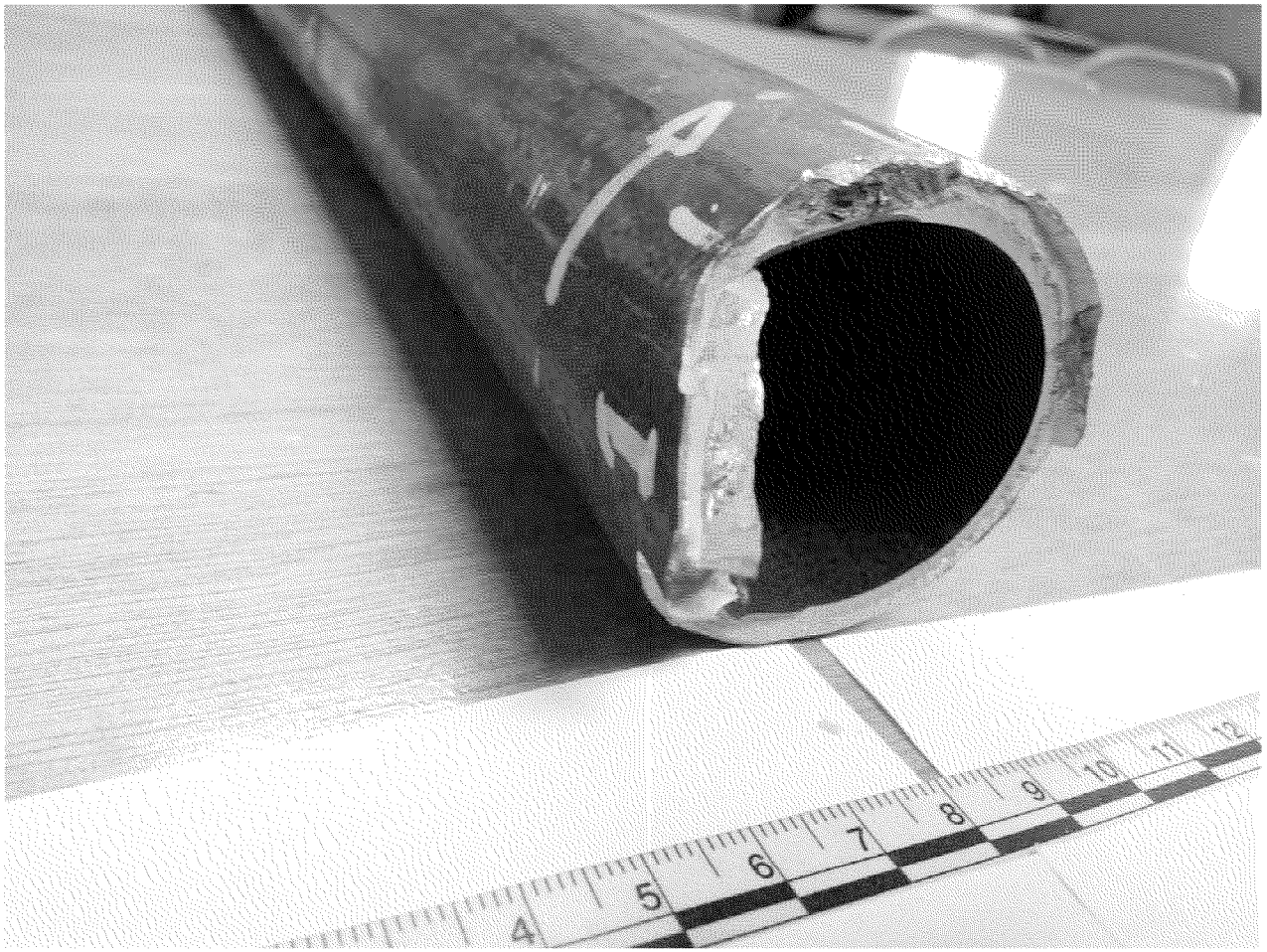
FIG. 2 shows a broken tube being in the brittle status after trying to coil with a radius of 48 inches in the as-quenched state.
Figure 3:
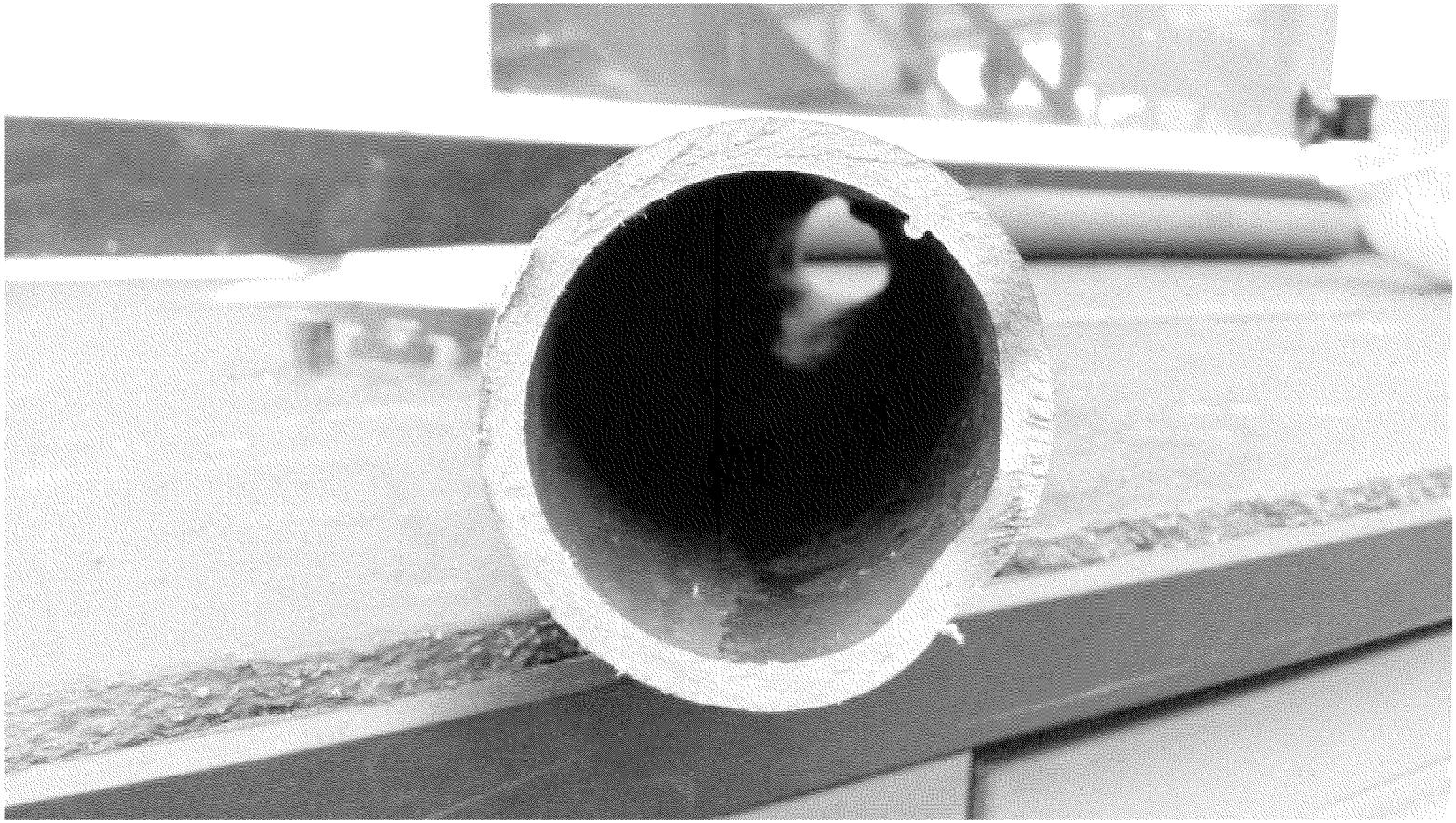
FIG. 3 shows another example of a broken coiled tube with insufficient tempering.
Figure 4:
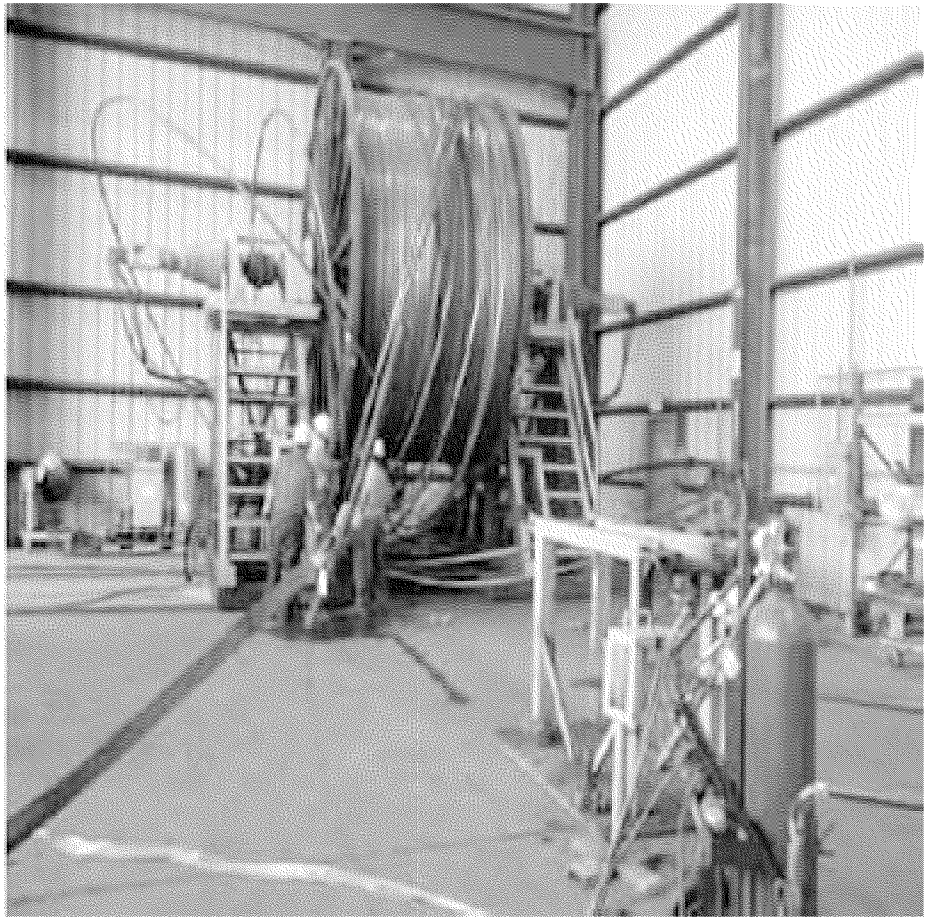
FIG. 4 shows a tube which has uncoiled itself because of the break and energy released from the coiling.

This is something that is not possible for as-quenched pipes without resulting in the generation of defects, or even experiencing a catastrophic failure as shown in FIGS. 2-4. For example FIGS. 2-3 show a cleavage effect whereas FIG. 4 illustrates an uncoiling, both of which can result from a sudden release of energy due to incomplete tempering before bending. Specifically, a catastrophic propagation of cracks in a brittle tube can occur leading to the problematic occurrences.

The pipes produced by quench and tempering are extremely hard and brittle after quenching; the introduction into the heating chamber of the prior art has the objective of tempering such hard material. When performing trials trying to apply load to a pipes in the "as quench" state, it has been proven a challenge to introduce hard quenched coiled tubing into a chamber that requires bending, since the required loads are too high and there is tendency of the material to crack (low toughness).

Pre-Bending Tempering Operation

Embodiments of the present disclosure provide a continuous heat treatment of a coiled tube with minimal deformation of the coiled tube during the heat treatment to prevent cracking or breaking of the tube upon bending, coiling, and/or spooling. Specifically, a tempering operation can be performed on an uncoiled, straight, or mostly straight tube (e.g., no more than one bend) prior to coiling/re-coiling, which can prevent cracks/defects from forming during the coiling/re-coiling. In some embodiments, the tube can be straight, unbent, or uncoiled during an initial tempering operation.

In some embodiments, a heat treatment is disclosed wherein at most one bend or one bending operation is introduced in to the steel tube during tempering and prior to subsequent coiling. In some embodiments, a subsequent heat treatment can be performed where a bend can be applied, for example a bending to a furnace, in the case that the pipe cannot be tempered completely in a straight fashion. The advantage of heat treating the pipe after coiling into a heated chamber, or other confined space, is to reduce the overall length or footprint of the heat treating mill.

Figure 5:
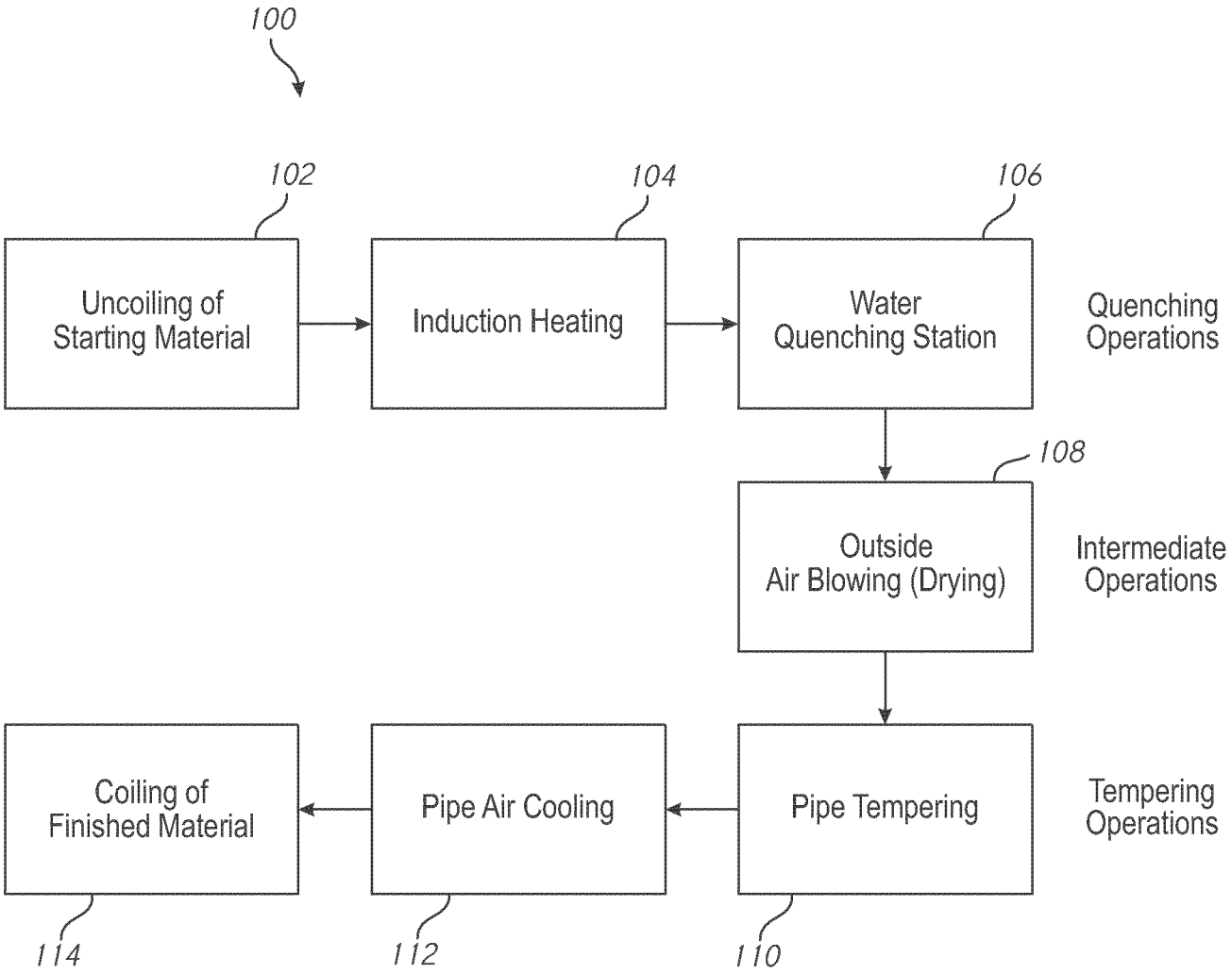
FIG. 5 shows a general process of quench and tempering treatment according to some embodiments.

FIG. 5 shows the steps of an embodiment of the heat treatment of the disclosure 100. First, the starting material/tube can be uncoiled 102, though in some embodiments the starting material may not be coiled in the first place. Next, the material can go through an induction heating process 104 so as to achieve a temperature above Ac3. Following, the tube can be quenched 106. The tube can be water quenched, as shown in FIG. 5, or can be air quenched. Other quenching methods can be used as well. Next, intermediate operations, such as outside air blowing (drying), can be performed 108. Prior to any coiling or bending of the tube, pipe tempering can occur 110. After tempering, the pipe can be air cooled 112 in some embodiments. After all these procedures, the tube can be coiled 114, thereby minimizing stress and potential crackage/breakage of the pipe. In some embodiments, further tempering can be optionally performed after coiling 114 to further adjust the characteristics of the steel pipe. In some embodiments, advantageous properties can be achieved during the pipe tempering 110, and no further tempering may be performed.

Thus, as mentioned above, a steel pipe can be initially quenched 106. This can be performed as either a fast quench or a slow quench. The as-quenched pipe can be generally, or completely, free of defects. However, due to its as-quenched nature, the as-quenched pipe can be generally brittle. Specifically, quenching can lead to a stressed material in which the carbon atoms and other allowing element have been "frozen" within the microstructure in a limited space. This can produce tension to accommodate extra carbon (or other elements), and tempering allows for some carbon to precipitate out giving more ductility.

Figure 6:
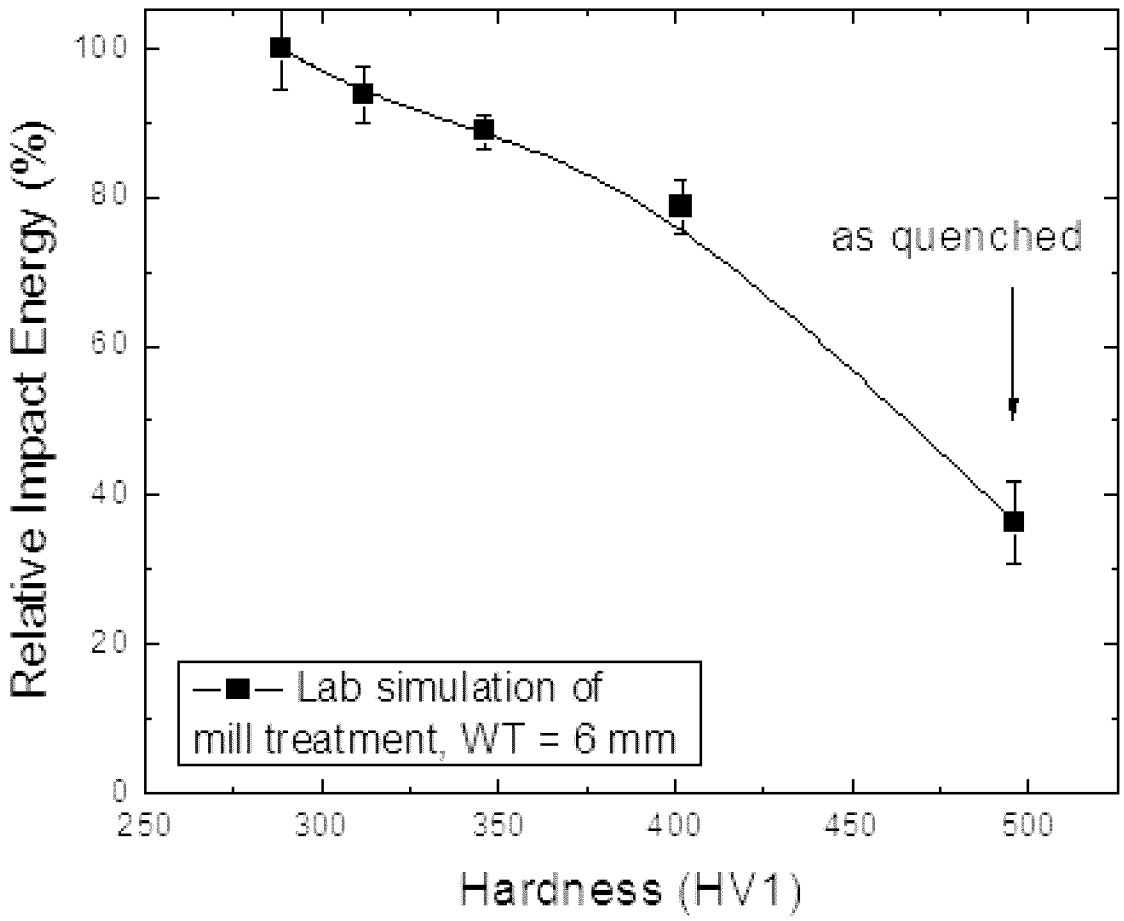
FIG. 6 shows a graph comparing hardness and relative impact energy for embodiments of the disclosure.

Unlike the methods described in the prior art, the as-quenched pipe can be subjected to different heat treatments, such as tempering treatments, in order to reduce hardness and improve toughness prior to any bending that will significantly strain the as-quenched or lightly tempered pipe, such as bending the pipe to fit within a tempering furnace. This is shown as the tempering operation steps 110/112 of FIG. 5. In some embodiments, the toughness of the as-quenched tube is 30% (or about 30%) of the toughness of the tempered product, though the particular change is not limiting. As shown in FIG. 6, as hardness increases impact energy (e.g., toughness) can decrease. This procedure can be used to avoid cracking of the pipe or de-rating of fatigue due to the introduction of micro cracking. Further, by avoiding the chamber and rolls in the non-bended chamber during tempering, the pipe could avoid contact with cold surfaces that can reduce the heat extraction and introduce heterogeneous properties in the pipe.

The initial tempering heat treatment 110 can be characterized by a parameter that is an integral of time-temperature for the tempering cycle and can take into account the easiness of the material to be tempered. There is an amount of heat treatment that can be performed before any bending is applied, and after the heat treatment the pipe could be bent 114 (for spooling or further heat treatment) without developing cracks or micro-cracks, or substantially without developing cracks or micro-cracks. Cracks can be visually seen in a finished product. Micro-cracking can relate to cracking at a level of the material microstructure. Thus, a material could be micro-cracked at a microstructural level but if integrity is not lost, it may not form cracks In other words, tempering procedures can be used to achieve a minimum ductility to avoid defect generation when the pipe is coiled. Consequently, the total (T) amount of required tempering parameter (P) to attain a particular pipe grade (PT) can be divided into a first stage in which the tempering occurs without bending ($P_L$) and the remaining of the tempering applied with bending ($P_C$) in a second stage after the minimum ductility has been obtained. PT is the total (T) amount of tempering (defined by P) to attain the final grade (mechanical properties). Thus, in some embodiments PT can be $P_L+P_C$. However, in some embodiments $P_C$ may be zero. In some embodiments, $P_L$ can be 10, 20, 30, 40, 50, 60, 70, 80, 90, 95, 99, or 100% of PT (or about 10, about 20, about 30, about 40, about 50, about 60, about 70, about 80, about 90, about 95, about 99, or about 100% of PT). In some embodiments, $P_L$ can be greater than 10, 20, 30, 40, 50, 60, 70, 80, 90, 95, or 99% of PT (or greater than about 10, about 20, about 30, about 40, about 50, about 60, about 70, about 80, about 90, about 95, or about 99% of PT).

The remaining tempering that could be applied with bending ($P_C$) that may be performed in a second stage after the minimum ductility has been obtained is an optional step. This second stage of tempering may be utilized after coiling 114 in which, after the properties of the pipes have been already modified to avoid defects generation, the pipe is introduced into a furnace chamber in which it is bent to increase residence time. In some embodiments, the second tempering can be used to attain the final mechanical properties of the product without introducing defects thanks to the effect of the first tempering. In some embodiments, the chamber furnace can be an alternative once the properties have been reduced to a certain level in which defects are not expected to be generated. In some embodiments the second stage of tempering may only be required if spaced is needed to be saved.

EXAMPLE

In the following example, a steel comprising, by weight %: C: 0.25%, Mn: 1.4%, Si: 0.2% was quenched to obtain full martensite microstructure (hardness level of 500 HV). The Vickers hardness was measured according to standards ASTM E384 and ISO 6507, the entirety of each of which is hereby incorporated by reference. The steel tube had an as-quenched condition yield-strength of 200 ksi, which is 80% greater with respect to the final properties (e.g., after all tempering). Further, the formed pipe had an outer diameter (OD) of 2 inches, a wall thickness (WT) of 0.204 inches, a coil radius ($R_C$) of 48 inches, and a steel grade with 110 ksi of minimum yield strength. However, this is merely an example composition and configuration and other types of compositions/configurations can be used as well.

Figure 7:
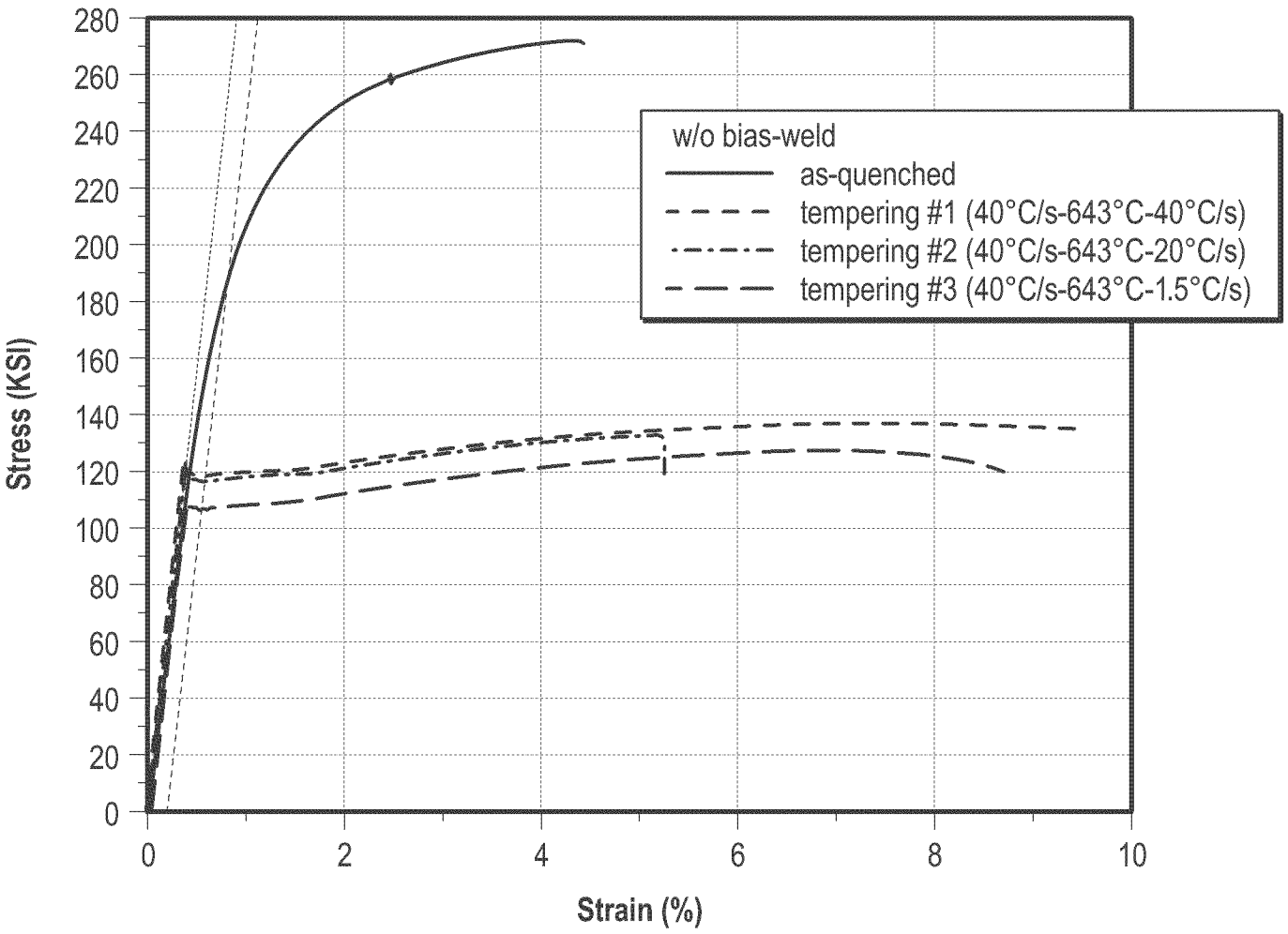
FIG. 7 shows tensile tests performed after different tempering treatments (strength value).
Figure 8:
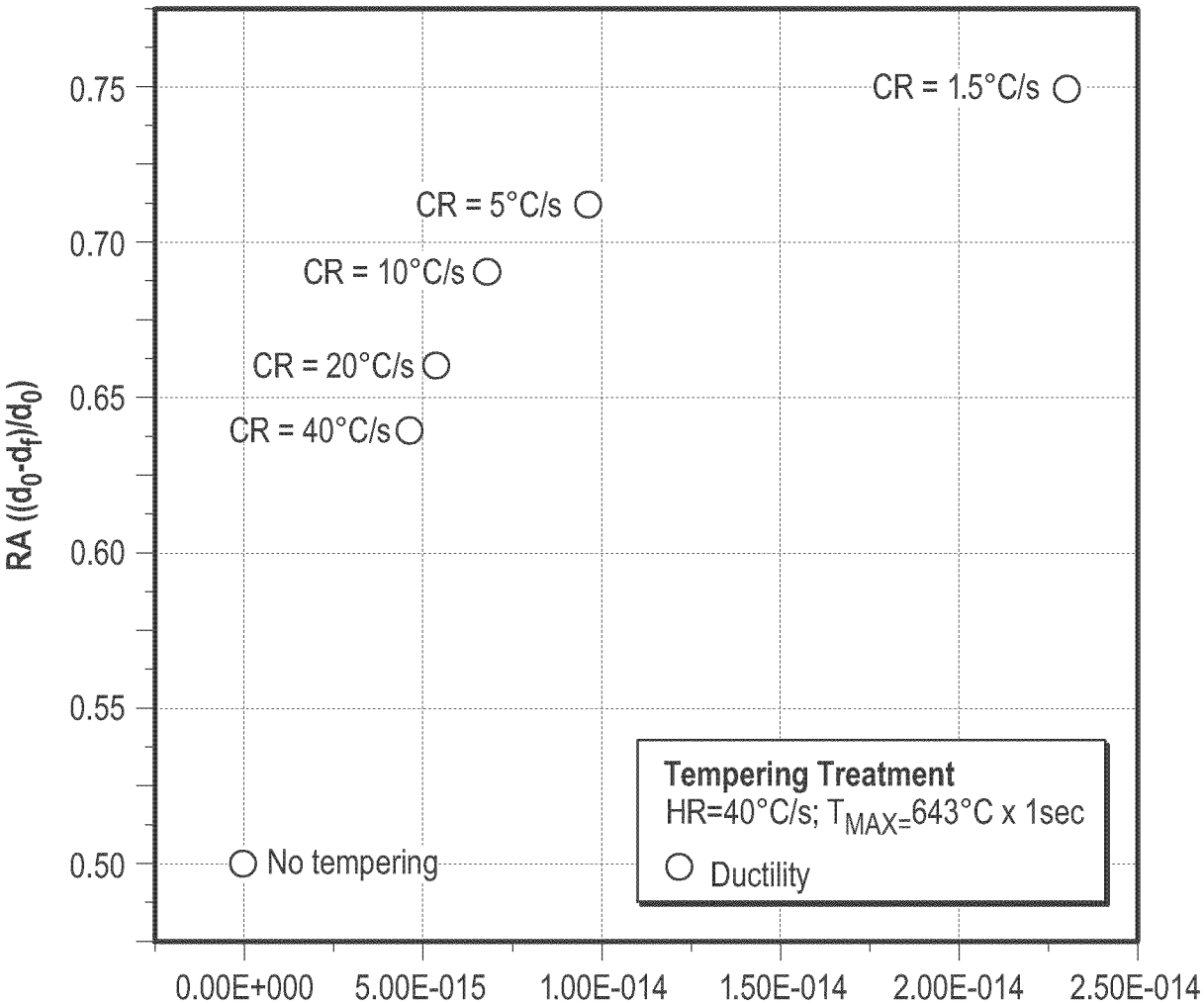
FIG. 8 shows ductility as a function of the tempering parameter.

FIGS. 7-8 illustrate properties of the steel example for discussion purposes, though these values can change depending on the composition of the steel.

FIG. 7 shows a stress-strain graph of the composition disclosed above. In particular, FIG. 7 shows that ductility increases and tensile strength decreases as the tempering parameter P increases. In the as-quenched condition, the material ruptures at 5% (or about 5%) of total deformation showing a brittle behavior. However, tempering can greatly increase the deformation, allowing over 8% (or over about 8%) or over 9% (or over about 9%). Tempering #2 shows a test that was interrupted, and material rupture is not shown.

FIG. 8 illustrates tempering prior to bending as compared to the percent reduction of area after tensile testing (RA). As shown, with no tempering, the material has very brittle behavior. However, as shown in FIG. 8, tempering treatments can greatly reduce the brittleness, thus resulting in higher RA. When the tube is too hard (causing brittleness), there is a maximum capability to apply load, and thus the bending radius can increase, thereby requiring large heating chambers/furnaces.

As discussed herein, two advantages could be obtained by applying tempering in the straight or un-bent form prior to coiling: a) coiling force reduction and b) no defects generation due to loss of ductility.

The coiling strain ($\varepsilon_c$) can be calculated using the following Equation 1.

$$\varepsilon_C = \frac{OD - WT}{2.R_C} \times 100 \tag{1}$$

Thus, for the example steel, coiling strain would be equal to 2% (or about 2%).

Typically a pipe of 140 ksi could be straightened in industrial machines and could be coiled with no defects associated to the process. For example, FIG. 17 of European App. No. EP2778239A1, hereby incorporated by reference, shows that a 140 ksi pipe (a pipe having yield strength of 140 ksi) has been produced that has excellent fatigue life after bending on a 48 inch radius block, simulating multiple bending operations.

Hence reducing the yield strength (YS) before applying any bending down to 140 ksi may be advantageous in order to produce a defect free pipe while being industrially feasible with typical straightening/bending industrial apparatus. Thus, in some embodiments tempering can be performed to achieve a yield strength of 140 ksi (or about 140 ksi) or below.

If the as-quenched material of the example is to be bent with a machine that is limited to 140 ksi load, the maximum strain in the resulting pipe strain can be 0.5% (or about 0.5%) according to FIG. 7. For a 2 inch OD pipe with a WT of 0.204 inches, the resulting radius for a furnace similar to the one described in previous art will have approximately nine meters in diameters. A nine meter diameter is clearly an enormous furnace which is not compatible with typical industrial facilities. This shows that a straight HT (Heat Treatment) can be advantageous for industrial feasibility and defect free product on a HT that is quenched.

Secondly, the ductility could give an idea of the tendency of the material to crack without deformation, and thus the possibility of introducing defects in the pipe that could affect the fatigue life of the product during use.

The ductility was determined by comparing the reduction of sample area after tensile testing ($\pi/4d_f^2$) with the initial sample area ($\pi/4d_0^2$). Generally, when a sample is broken under load, if the final area is generally equal to the initial area, the material has parted and ductility is low. If the final area is smaller than the initial area, for example much smaller, the material has yielded and the ductility is high. During the tensile test, $d_0$ and $d_f$ represent the initial diameter ($d_0$) and final diameter ($d_f$) of a cylindrical shape. RA is the percent reduction of area after a tensile test and it is an indicator of ductility as shown by Equation 2:

$$RA(\%) = \frac{d_f^2 - d_o^2}{d_o^2} \times 100 \tag{2}$$

FIG. 8 presents the increase in ductility as a function of the tempering parameter. The tempering treatment was performed keeping heating rate, maximum temperatures and soak time as constants and changing the cooling rate. Ductility could be increased at least 50% with tempering at a temperature in the range of 50° C. to 75° C., but 50% of that ductility recovery occurs after a light tempering is applied $P_L$: $5\times10^{-5}$.

In general, the minimum ductility for bending can depend on the bending curvature radius and pipe geometry and the bending strain introduced by such bending/coiling process. There is then a relationship between minimum ductility (ΔMIN) versus $\varepsilon_C$ (coiling strain). The minimum ductility can depend on various factors and is part of a process of calibration.

The coiling strain ($\varepsilon_C$) is a function of OD, WT and coil radius ($R_C$). For different $\varepsilon_C$, the pipe can achieve a minimum ductility (ΔMIN) to avoid suffering any damage during coiling. The curve ΔMIN versus $\varepsilon_C$ is defined based on maximum allowed levels of strain and stress during coiling and crack susceptibility.

Figure 9:
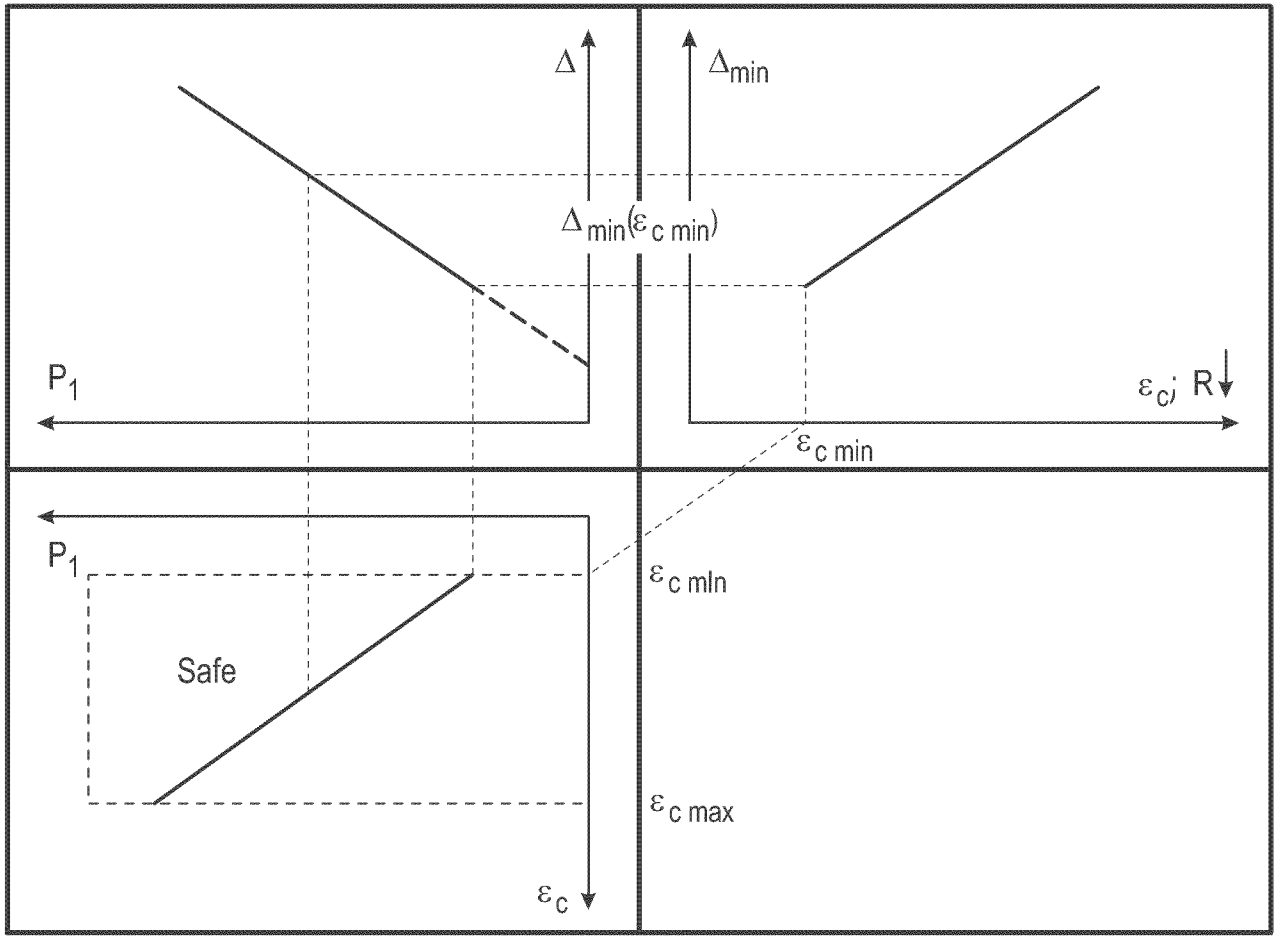
FIG. 9 shows a schematic overview of the minimum $P_L$ required for different $\varepsilon_C$ to avoid introducing defects during coiling.

Therefore, the relationship between tempering parameter P and ductility allows for defining the heat treatment that can be applied before bending $P_L$ for different $\varepsilon_C$ to avoid introducing defects during coiling. The minimum $P_L$ for different $\varepsilon_C$ to avoid introducing defects during coiling is depicted in FIG. 9. Specifically, FIG. 9 shows a schematic overview of the minimum $P_L$ required for different $\varepsilon_C$ to avoid introducing defects during coiling.

The upper-right graph indicates the relationship between the coiling strain (coiling strain min, coiling strain max) and the ductility. While coiling strain is applied, that strain depends on pipe OD, WT and the coiling radius (R). For a given level of strain a minimum ductility to guaranty there are no defects is needed.

In the upper-left graph, there is a relationship between ductility and tempering presented, similar to FIG. 8. The dashed line indicates ductility is too small for the deformation and thus P is insufficient.

The schematic overview in the lower-left corner shows the relation of both the strain with the tempering cycle $P_L$. If the tempering is more severe than $P_L$ (indicated as left of the line) there is a "safe" indication.

In this way, if the radius of bending inside the chamber is changed, the amount of tempering (P1) could be estimated immediately. If the steel is changed to a material with higher hardness or tempering resistance, the threshold heat treatment is such that produces a reduction in yield strength similar to the one observed during the application of the threshold P in a material with lower carbon. The equivalent tempering for different material could be estimated with a tempering model.

From the foregoing description, it will be appreciated that an inventive heat treatment method is disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount. If the stated amount is 0 (e.g., none, having no), the above recited ranges can be specific ranges, and not within a particular % of the value. For example, within less than or equal to 10 wt./vol. % of, within less than or equal to 5 wt./vol. % of, within less than or equal to 1 wt./vol. % of, within less than or equal to 0.1 wt./vol. % of, and within less than or equal to 0.01 wt./vol. % of the stated amount.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A method of heat treating a tubing comprising:

providing the tubing in an uncoiled configuration;

heating the tubing in the uncoiled configuration to a temperature above Ac3;

quenching the tubing in the uncoiled configuration;

tempering the tubing in the uncoiled configuration to a yield strength of about 140 ksi or below without bending, wherein the tempering is executed in a straight tube heat treatment; and coiling the tubing after the tempering.

2. The method of claim 1, wherein the tubing comprises a pipe.

3. A method of heat treating a coiled tubing, the coiled tubing comprising a pipe, wherein the method comprises:

unspooling the coiled tubing;

heating the unspooled coiled tubing to a temperature above Ac3;

quenching the unspooled coiled tubing; and tempering the unspooled coiled tubing to a yield strength of 140 ksi or below without bending, and wherein the tempering is executed in a straight tube heat treatment.

4. The method of claim 3, further comprising coiling the unspooled coiled tubing after the tempering.

5. The method of claim 3, wherein the tempering performed prior to bending is 100% of the total tempering.

6. A method of heat treating a tubing, wherein the tubing comprises a pipe, wherein the method comprises:

providing the pipe in an uncoiled configuration;

heating and quenching the pipe in the uncoiled configuration; and tempering the pipe in the uncoiled configuration to a yield strength of 140 ksi or below and without any bending of the pipe during the tempering, wherein the tempering is the total tempering of the pipe, wherein the yield strength of the pipe as-tempered is less than the yield strength of the pipe as-quenched, and wherein the tempering is executed in a straight tube heat treatment.

7. The method of claim 6, wherein the pipe is uncoiled from a spool prior to tempering.

8. The method of claim 6, further comprising coiling the pipe after the tempering.

9. The method of claim 1, wherein tempering the tubing comprises tempering the tubing to the yield strength of about 110 ksi to about 140 ksi.

* * * * *